US007595733B2

(12) United States Patent
Spagna

(10) Patent No.: US 7,595,733 B2
(45) Date of Patent: Sep. 29, 2009

(54) LOCKABLE PINLESS EAS TAG WITH LANYARD

(76) Inventor: Richard J. Spagna, 5158 NW. 52nd St., Coconut Creek, FL (US) 33073

( * ) Notice: Subject to any disclaimer, the term of this patent is extended or adjusted under 35 U.S.C. 154(b) by 242 days.

(21) Appl. No.: 11/288,970

(22) Filed: Nov. 29, 2005

(65) Prior Publication Data

US 2007/0120686 A1 May 31, 2007

(51) Int. Cl.
*G08B 13/14* (2006.01)

(52) U.S. Cl. ..... 340/572.8; 340/572.9; 24/16 PB

(58) Field of Classification Search ..... 340/572.8, 340/572.9; 24/16 PB, 30.5 P, 265 EC, 30.5 S
See application file for complete search history.

(56) References Cited

U.S. PATENT DOCUMENTS

| | | | | |
|---|---|---|---|---|
| 3,059,359 | A | 10/1962 | Goldammer et al. | |
| 3,837,047 | A | 9/1974 | Bunnell | |
| 3,860,997 | A | 1/1975 | Van Riper, Jr. et al. | |
| 3,942,829 | A | 3/1976 | Humble et al. | |
| 3,964,133 | A | 6/1976 | Wasserlein, Jr. | |
| 3,995,900 | A | 12/1976 | Humble et al. | |
| 4,103,572 | A | 8/1978 | Humble et al. | |
| 4,299,870 | A | 11/1981 | Humble et al. | |
| 4,676,535 | A | 6/1987 | Mautner | |
| 4,862,561 | A * | 9/1989 | Lichtenberg | 24/16 PB |
| 5,031,943 | A | 7/1991 | Scott et al. | |
| 5,408,212 | A | 4/1995 | Meyers et al. | |
| 5,428,875 | A | 7/1995 | Nguyen et al. | |
| 5,437,172 | A | 8/1995 | Lamy et al. | |
| 5,457,853 | A | 10/1995 | Klein | |
| 5,524,463 | A | 6/1996 | Schenkel et al. | |
| 5,687,455 | A | 11/1997 | Alexander | |
| 5,722,123 | A | 3/1998 | Davignon et al. | |
| 5,901,416 | A | 5/1999 | Mears | |
| 5,945,909 | A | 8/1999 | Kolton | |
| 5,969,613 | A | 10/1999 | Yeager et al. | |
| 5,988,462 | A | 11/1999 | Kolton | |
| 6,157,302 | A | 12/2000 | Kolton et al. | |
| 6,226,839 | B1 | 5/2001 | Sayegh | |
| 6,308,539 | B1 | 10/2001 | Kolton et al. | |
| 6,311,531 | B1 | 11/2001 | Sykes | |
| 6,326,890 | B1 * | 12/2001 | Costa | 340/572.9 |
| 6,352,606 | B1 | 3/2002 | DiMarco et al. | |
| 6,374,647 | B1 | 4/2002 | Holmgren | |
| 6,443,403 | B1 | 9/2002 | Page et al. | |
| 6,543,261 | B2 | 4/2003 | Kolton et al. | |

(Continued)

*Primary Examiner*—Daniel Wu
*Assistant Examiner*—Hongmin Fan
(74) *Attorney, Agent, or Firm*—Daniel C. Crilly; Kevin P. Crosby; GrayRobinson, P.A.

(57) ABSTRACT

A surveillance tag apparatus for goods of varying size and shape comprising a lanyard, a housing and a pawl. The lanyard includes a flexible, elongated body having parallel ridges across at least one side, the body ending in one stop member. The housing includes an inner surface defining an internal chamber and an outer surface defining a pair of lanyard receiving passages. The first passage of the pair receives the body and abuts the stop member before securing the lanyard to a good and the second passage receives the body after. The housing defines at least one aperture connecting the internal chamber and second passage. The pawl is positioned within the internal chamber and includes at least one protrusion through at least one aperture into the second passage to engage at least one parallel ridge when the lanyard is secured to the good, thereby inhibiting removal of the lanyard.

25 Claims, 11 Drawing Sheets

U.S. PATENT DOCUMENTS

| | | | | |
|---|---|---|---|---|
| 6,560,822 | B2 * | 5/2003 | Caveney et al. | 24/16 PB |
| 6,624,753 | B2 | 9/2003 | Elston | |
| 6,646,553 | B1 | 11/2003 | Kolton et al. | |
| 6,719,335 | B2 | 4/2004 | Velschou et al. | |
| D492,215 | S | 6/2004 | Lu | |
| 6,754,939 | B2 | 6/2004 | Belden, Jr. et al. | |
| 6,755,055 | B2 | 6/2004 | Sedon et al. | |
| 6,789,341 | B1 * | 9/2004 | Badura | 42/70.11 |
| D497,320 | S | 10/2004 | Sayegh | |
| 6,823,566 | B2 | 11/2004 | Coffey | |
| D505,350 | S | 5/2005 | Sayegh | |
| D506,694 | S | 6/2005 | Corney | |
| 6,933,847 | B2 | 8/2005 | Feibelman | |
| D509,454 | S | 9/2005 | Sayegh | |
| 2004/0051640 | A1 | 3/2004 | Benoite et al. | |
| 2005/0062608 | A1 * | 3/2005 | Costa | 340/572.9 |
| 2007/0146144 | A1 * | 6/2007 | Norman et al. | 340/572.8 |

* cited by examiner

LOCKABLE PINLESS EAS TAG WITH LANYARD

BACKGROUND OF THE INVENTION

1. Field of the Invention

This invention relates generally to the field of electronic article surveillance ("EAS"), and more particularly relates to a novel EAS tag and companion lanyard which can be placed in releaseably lockable engagement with an article over which security precautions are being exercised without the use of a locking pin.

2. Related Art

Devices used to affix EAS tags to retail merchandise and other items over which security precautions against theft is desired are legion. One example is shown in U.S. Pat. No. 3,995,900 to Humble et al. which shows a reusable security tag comprised of a housing containing a detectable element, such as a passive tuned circuit being responsive to a surveillance signal, in the form of, for example, electromagnetic, acousto-magnetic or radio frequency energy, and a pin adapted to be passed through a garment and through one or more corresponding apertures in the housing. The pin is held in place within the housing by a metal clutch lock to thereby sandwich the garment between the tag housing and the pin. The pin is removed from engagement with the clutch lock by a special detachment apparatus, which applies force to the clutch lock in such a way as to cause the clutch lock to disengage from the pin. The object of this device is to permit for easy attachment of the tag to the garment or article to be monitored but to prevent easy removal by unauthorized hands. On the other hand, the retail clerk must have a simple convenient means for readily removing tags from garments which, due to purchase or other reasons, may be removed legitimately from the premises.

Numerous other EAS tag attachment apparatus have been proposed, the vast majority of Them being of the type which also utilize a releaseably securable pin as discussed above. Some of these other devices employ a strap or lanyard, similar to the well-known "tie wraps", such as that disclosed in U.S. Pat. No. 5,031,943 to Scott et al. which discloses a bundling strap having an elongated thin strap body connected to a locking head end, the strap being adapted to be looped back upon itself and inserted into the head end. The head end defines an aperture or passage corresponding generally in shape to the cross-sectional configuration of the strap. Serrations or ratchets defined by the strap body matingly engage corresponding teeth defined by the passage in the head end to permit the strap to be inserted into and passed through the passage in one direction but not to be withdrawn therefrom. Such arrangements have been used to attach EAS tags to merchandise using pin-type attachments, such as U.S. Pat. No. 5,524,463 to Schenkel et al., U.S. Pat. No. 6,226,839 to Sayegh, and others.

Many articles of merchandise are not susceptible to having an EAS tag attached thereto using a pin, as either the dimensions of the article or the material out of which the article is made are not susceptible of being pierced by a pin. Therefore, attaching an EAS tag to an article using a releaseably secured lanyard that does not utilize a pin and that is of simple construction and inexpensive is desired.

It is, therefore, an object of the present invention to provide a theft deterrent tag and attachment assembly which can be attached to irregularly shaped articles.

It is a further object of the present invention to provide a theft deterrent tag and attachment assembly which is of simple construction and is inexpensive to use.

It is yet a further object of the present invention to provide a theft deterrent tag and attachment assembly which is adapted to permit conventionally-shaped EAS housings to be attached to articles without the use of a pin-type attachment structure.

SUMMARY OF THE INVENTION

In accordance with the principles of the present invention, the above and other objectives are realized in a theft deterrent tag and attachment assembly in which the attachment assembly comprises a strap or lanyard which is either integrally formed (e.g. molded) or otherwise cooperates with an EAS tag housing, the strap being comprised of a first end either releaseably or integrally attached to the EAS tag housing and a second end adapted to be looped back upon itself (and around a portion of an article to be secured) and passed through a passage defined by the EAS tag housing. The lanyard defines a plurality of ratchet or teeth-like projections adapted to be engaged by a corresponding pawl member pivotally secured within the EAS tag housing. The pawl member is normally biased into a first position in which it engages the ratchets on the lanyard body, the pawl member being pivotable into a second position in which it is disengaged from the ratchets on the lanyard body such that the lanyard body can be removed from the passage in the housing and thereby separated from the article. The pawl member may be moved from the first position to the second position using any one of the standard detachment devices (i.e., detachers) known to those of skill in the art. However, any apparatus capable of bringing about the results described herein is within the scope of the invention therefore. Numerous structural arrangements for facilitating the positioning and reciprocating movement of the pawl member are contemplated by the invention.

The objects and advantages, as well as the particular structural arrangements, of the instant invention recited herein are only examples and should not be construed as limiting the invention. The invention will be further understood from consideration of the following description of various aspects and embodiments thereof and from the drawings herein. Other objects and advantages of the invention will become more apparent from the detailed description of the invention and claims that follow.

DETAILED DESCRIPTION

As is well known in the art of electronic article surveillance, tag systems such as that shown and described herein utilize a passive tuned circuit that is responsive to electromagnetic, acousto-electric or radio frequency energy (an example of which is shown as "C" in FIGS. 12A, 12B, 15A and 15B) which, when placed within the space or chamber defined by first and second housing halves 16, 18, will cause an alarm to sound when the tag is moved into a surveillance zone, such as the space between one or more EAS antenna in a retail establishment. Utilization of the present invention facilitates the easy and inexpensive attachment and detachment of these security tag systems to large or irregularly shaped articles or articles which are not susceptible of being penetrated by attachment pins, while at the same time permitting the detachment of the tags from the articles through use of conventional detachment mechanisms. By doing so, EAS tags and the securement structure employed by the present invention can be implemented in the market place without requiring retailers or other users of EAS tags to purchase additional detachment equipment. Alternatively, the attachment structure of the invention may be implemented in EAS tags of any configuration, even those not presently in existence, it being understood that the particular structural arrangements disclosed herein are merely examples of the numerous implementation structures of the invention.

Figure 18:
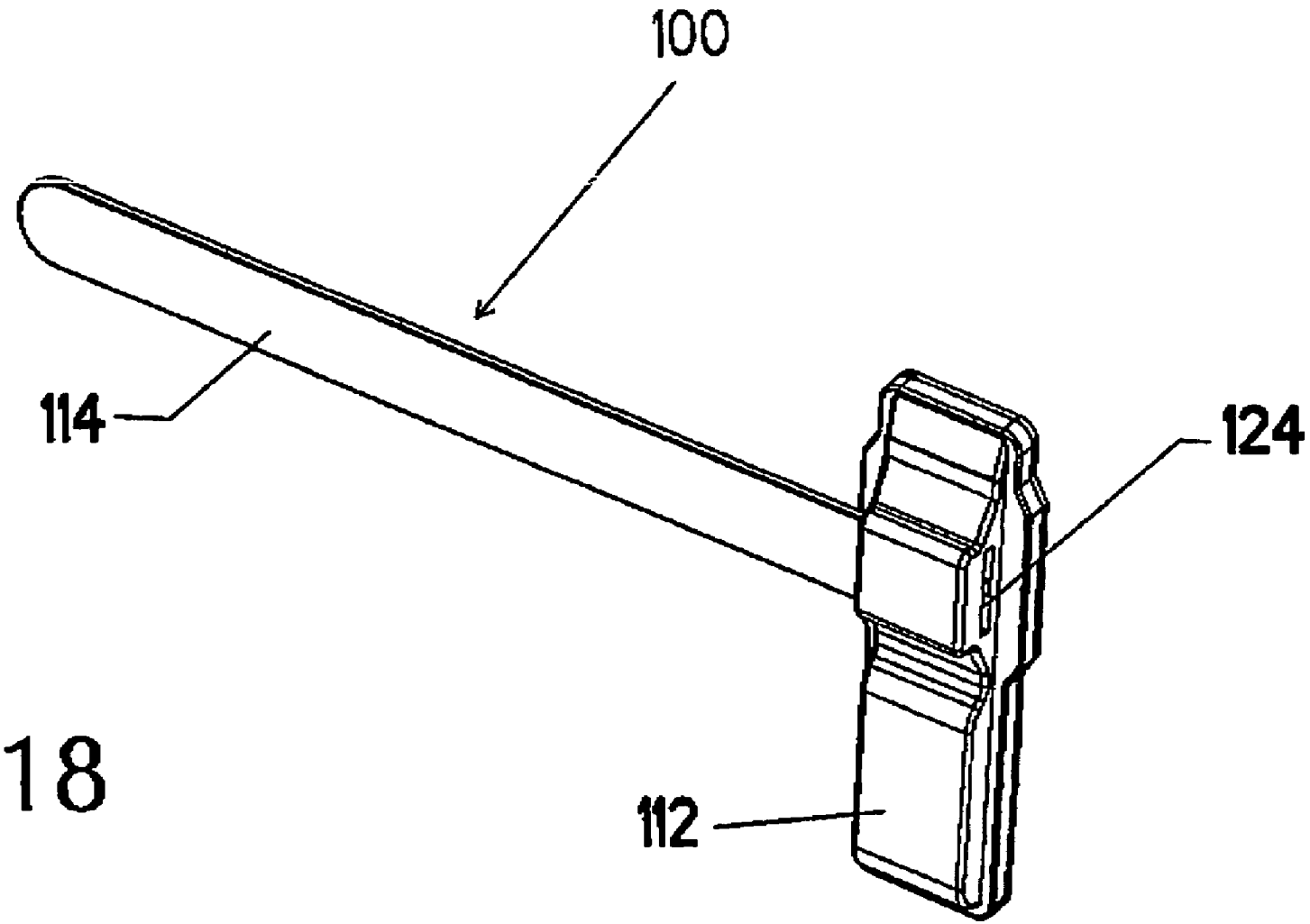
FIG. 18 is a perspective view of a theft deterrent tag and attachment assembly in accordance with another alternative embodiment of the present invention.

FIGS. 1 through 13B show a theft deterrent EAS tag system 10 which is generally comprised of a housing, the housing including first and second housing halves 16, 18, and a lanyard or elongated strap 14. In the embodiments shown herein, strap 14 has connected to its proximal end a head 15 which is dimensionally wider than the elongate body of strap 14 for reasons which will become apparent hereinafter. However, it is to be understood that strap 14 may be integrally connected to, and/or formed with or as part of, second housing half 18 without departing from the spirit and scope of this invention. One exemplary embodiment of a tag attachment assembly 100 that includes a housing 112 having an integrally formed lanyard or strap 114 is illustrated in FIG. 18. In this embodiment the lanyard or strap 114 is integrally formed into the outer surface of one of the housing members 112. When the assembly is placed into use, the lanyard 114 is looped around the article to be protected and passed through strap aperture 124, such tat serrations defined by the strap 124 are engaged by the pawl member situated within the assembly 100 as described in detail below. To integrally form the strap 114 as part of the housing member 112, the housing member 112 and the strap 114 may be molded as one piece or combined after manufacture in any known manner such as ultrasonic welding, adhesion, other fastening or the like.

First housing half 16 is adapted to be mated together with second housing half 18 such that their inner surfaces form an interior volume or chamber therebetween. Extending into the interior volume are one or more force exertion projections, such as dimples 32, 34 and a biasing member 30. Second housing half 18 defines, on its bottom exterior surface, first and second strap passages 24, 26, as well as a strap head end stop member 22. Second housing half 18 also defines, on its interior facing surface, one or more pawl access windows 78 (one shown) and pawl member retention posts 70, 72, 74 and 76.

Pawl 40 in the preferred embodiment is a generally T-shaped member comprised of a rectangular element 48 connected to a yoke 51, which is turn supports one or more claws, arms, protrusions, or other strap engagement elements 42. Pawl 40 has a slight bend formed therein at or near the juncture of rectangular element 48 and yoke 51, forming a fulcrum line 46 about which pawl 40 is permitted to pivot against the interior surface of second housing half 18, generally along dashed line 80 shown in FIG. 8. Second housing half 18 also defines pawl retention posts 70, 72, 74 and 76, which retain pawl 40 in pivotal engagement with second housing half 18. Pawl 40 also defines a bearing surface 49, the purpose of which will be described more fully hereinbelow.

Figures 12A, 13A:
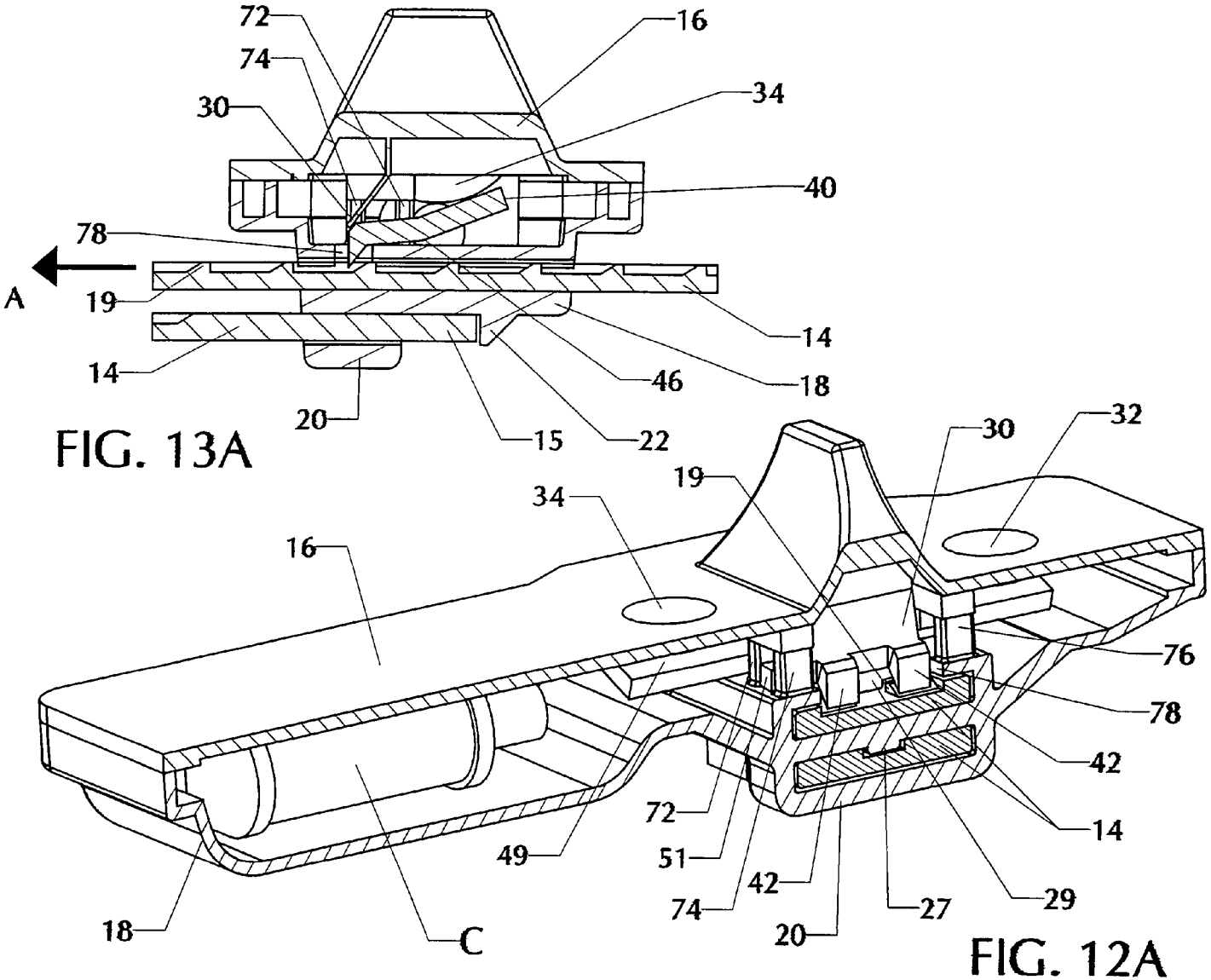
FIG. 12A is a cross-sectional front elevational view of the invention taken along lines 12-12 of FIG. 11 showing the pawl member in the engaged position.
FIG. 13A is a right side cross-sectional left side elevational view of the invention taken along lines 13-13 of FIG. 10 showing the pawl member in the engaged position.
Figures 12B, 13B:
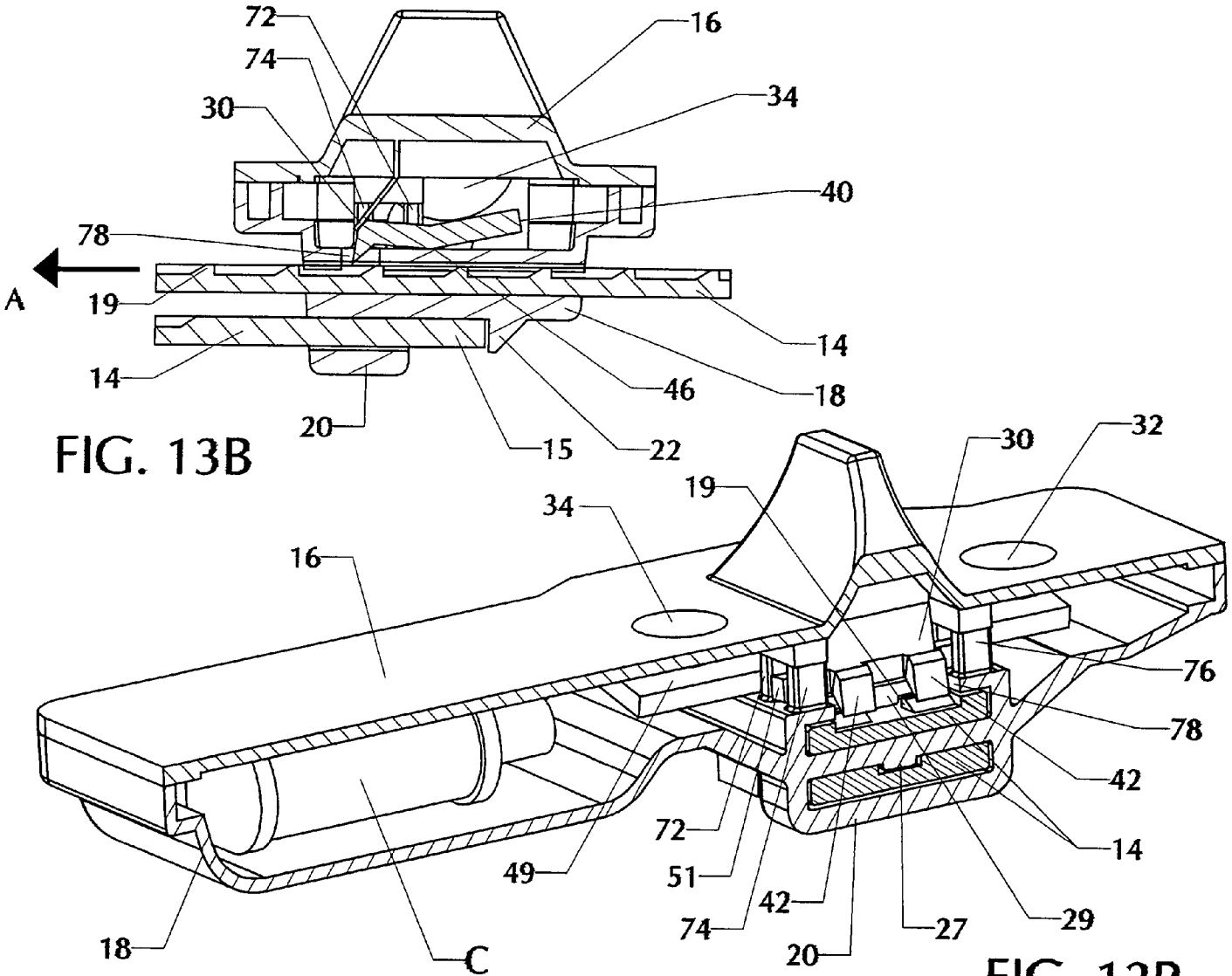
FIG. 12B is a cross-sectional front elevational view of the invention taken along lines 12-12 of FIG. 11 showing the pawl member in the disengaged position.
FIG. 13B is a right side cross-sectional elevational view of the invention taken along lines 13-13 of FIG. 10 showing the pawl member in the disengaged position.
Figure 15A:
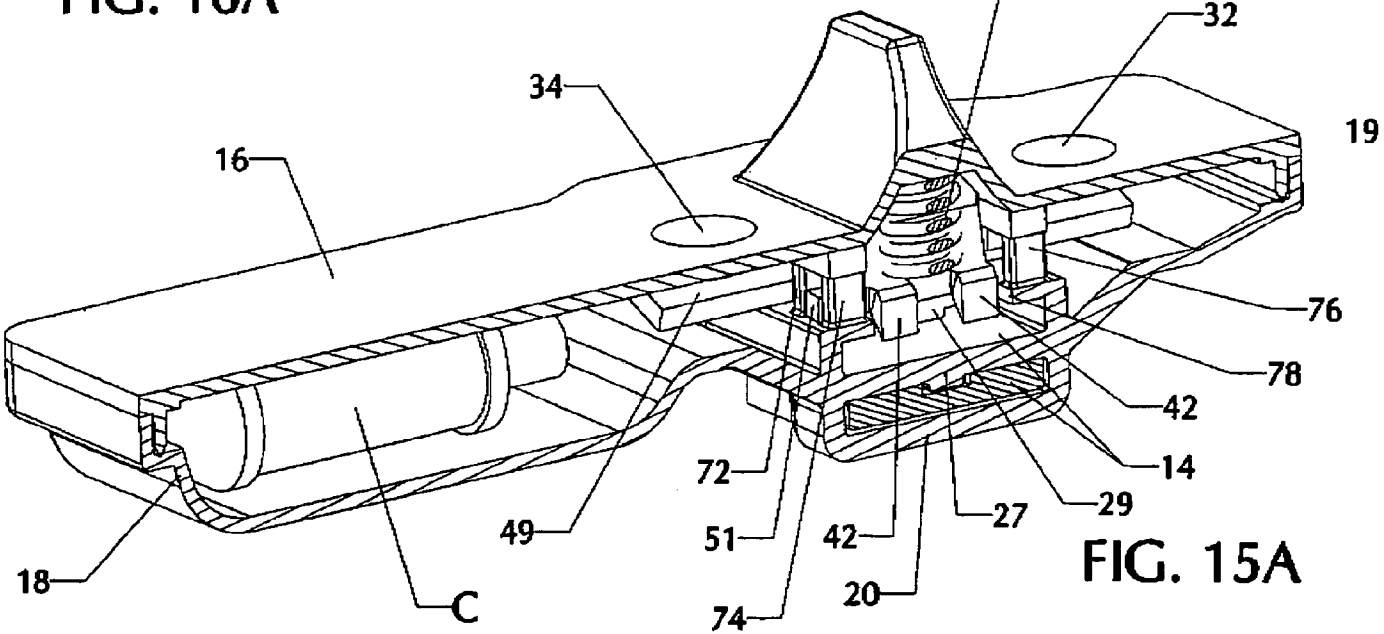
FIG. 15A is a front cross-sectional elevational view of the second embodiment of the invention similar to the view of the first embodiment of the invention shown in FIG. 12A showing the pawl member in the engaged position.

A biasing member 30 is employed to retain pawl 40 in its at rest position shown in FIGS. 12A and 13A. Biasing member 30 may be integrally formed with first housing half 16 (as shown as FIGS. 1 through 13A), or may be a helical spring 130 as shown in FIGS. 14 through 16B. Alternatively, the biasing member 30 may be a leaf spring or any structure which will exert a force on yoke 51 of pawl 40 sufficient to retain pawl 40 in the engaged position shown in FIGS. 12A, 13A, 15A and 16A, when the device 10 is at rest, but which will permit pawl 40 to pivot to the disengaged position shown in FIGS. 12B, 13B, 15B and 16B when dimples 32, 34 (or other force exerting structure) are forcibly placed into engagement with bearing surface 49 of pawl 40. Dimples 32, 34, which extend into the space between housing halves 16 and 18, exert force against bearing surface 49 of pawl 40 to cause pawl 40 to pivot from the at rest position shown in FIGS. 12A, 13A, 15A and 16A to the detached position shown in FIGS. 12B, 13B, 15B and 16B when engaged from the exterior of tag 12 by a tool such as a standard detachment device.

In one embodiment, strap 14 defines an elongated groove or channel 17 between teeth 19 which are adapted to nest with raised tabs or projections 27 and 29 when strap 14 is passed through first and second strap passages 24, 26, respectively. Tabs 27, 29 prohibit the introduction of a tool into passageways 24, 26 while strap 14 is disposed therein, which could otherwise be used in an attempt to thwart the device by removing strap 14 in an unauthorized manner. It is to be understood, however, that the invention 10 will work quite suitably without the employment of tabs 27, 29 and corresponding slot 17 in strap 14.

Briefly described, when it is desired to attach one of the EAS tag devices 10 of this invention to an article, strap 14 is passed through first strap-receiving aperture 24 defined by second housing half 18 such that head end 15 sits between the U-shaped structure 20 and head and stop member 22, as shown in FIGS. 1, 2, 9, 10, 12A, 12B, 15A and 15B. Strap 14 defines a plurality of teeth, projections, serrations, or ratchets 19, which are arranged in such a way that, when strap 14 is looped back upon itself and passed through second strap aperture 26, the serrations will be engaged by pawl member 40 situated within tag 12, thereby precluding strap 14 from being moved other than in the direction indicated by the arrow "A" shown in FIG. 13A until pawl member 40 is rotated about fulcrum 46 such that engagement claws 42 are caused to be moved out of engagement with teeth 19.

It is to be understood, however, that the step of passing strap 14 through aperture 24 will be unnecessary in the event strap 14 is integrally formed with or integrally connected to housing member 18.

Figure 1:
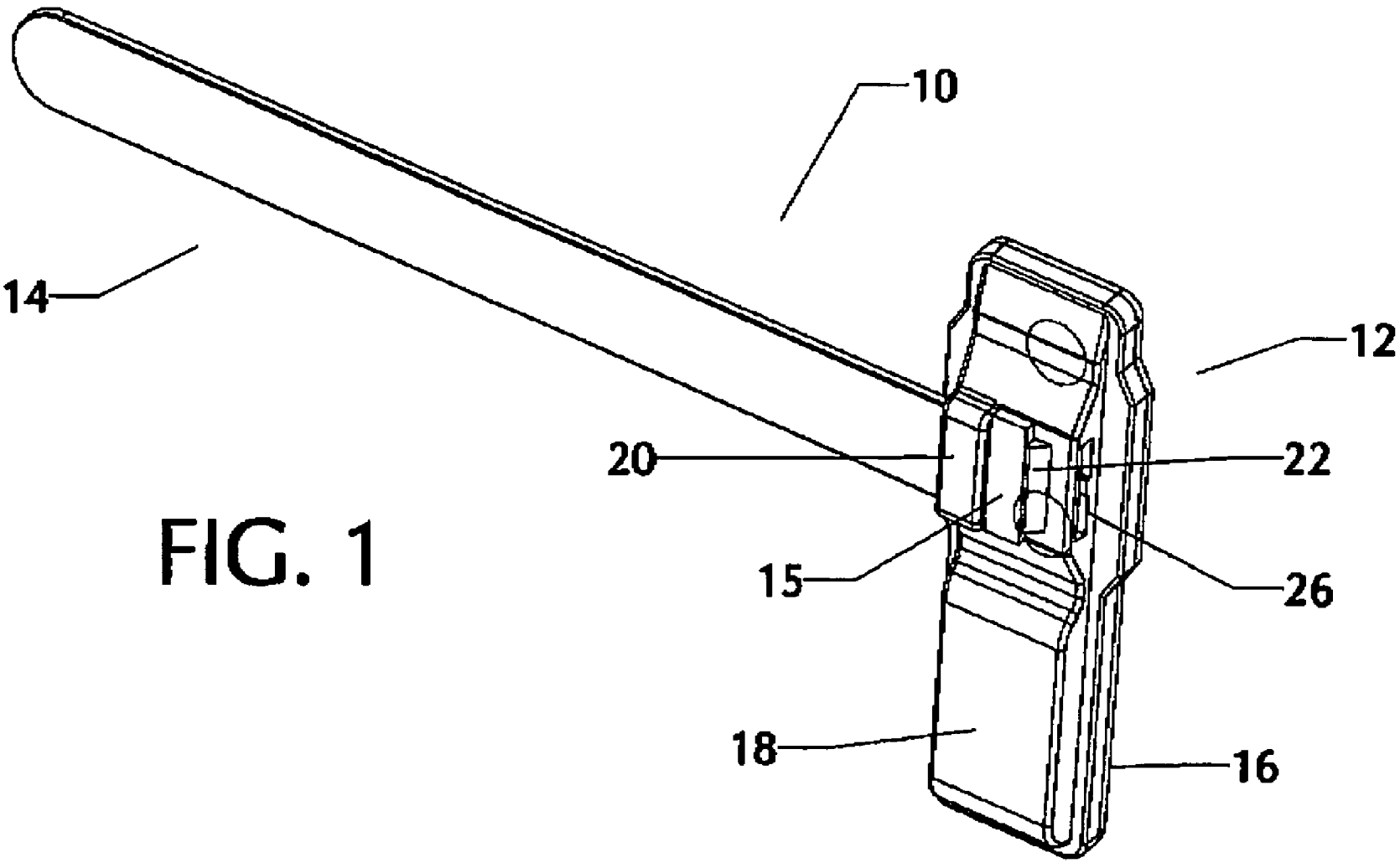
FIG. 1 is a perspective view of a first embodiment of the theft deterrent tag and attachment assembly of this invention.
Figure 2:
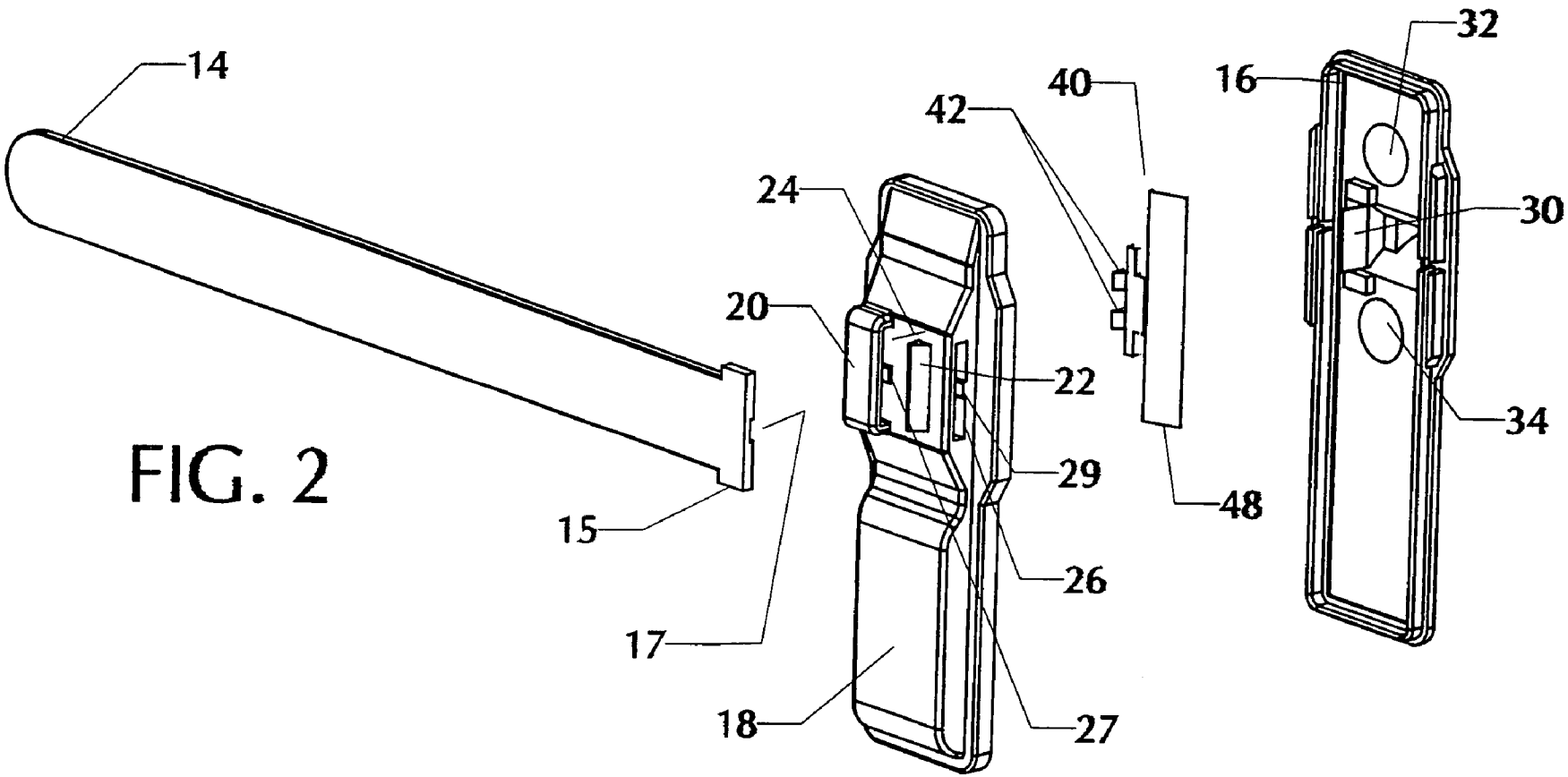
FIG. 2 is an exploded perspective view of the first embodiment of the invention.
Figure 4:
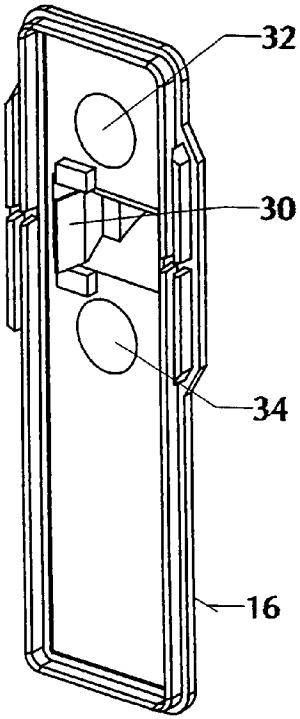
FIG. 4 is a perspective view of the first tag housing half shown in FIG. 3.
Figure 3:
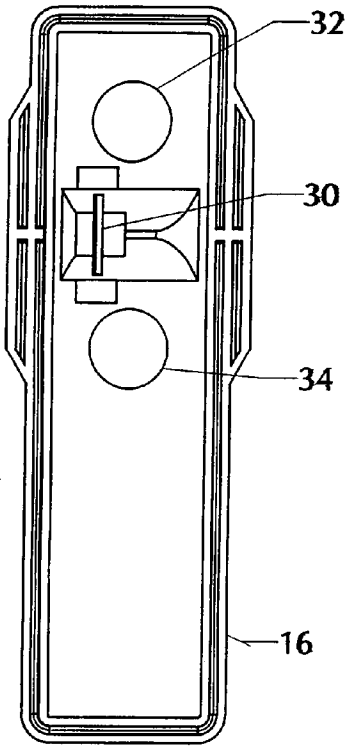
FIG. 3 is a top plan view of the inside of a first half of the tag housing of the invention.
Figure 5:
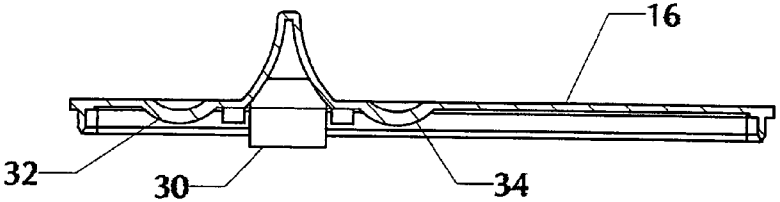
FIG. 5 is a left side elevational view of the tag housing half of FIG. 3.
Figure 7:
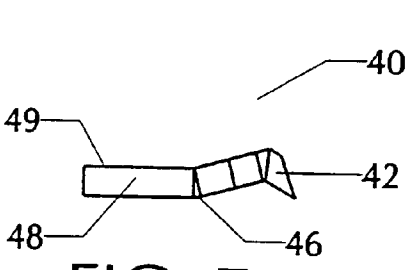
FIG. 7 is a left side elevational view of the pawl member.
Figure 6:
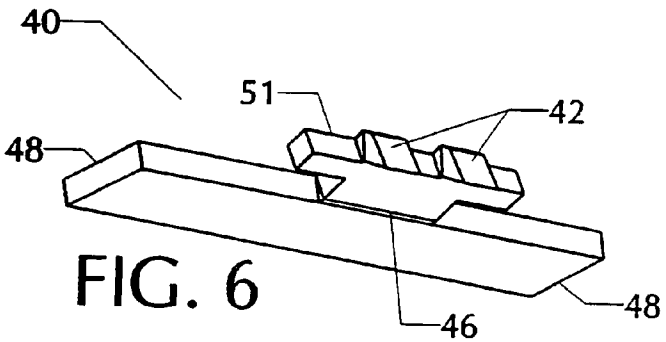
FIG. 6 is a bottom perspective view of one example of a suitable pawl member which can be used with the invention.
Figure 10:
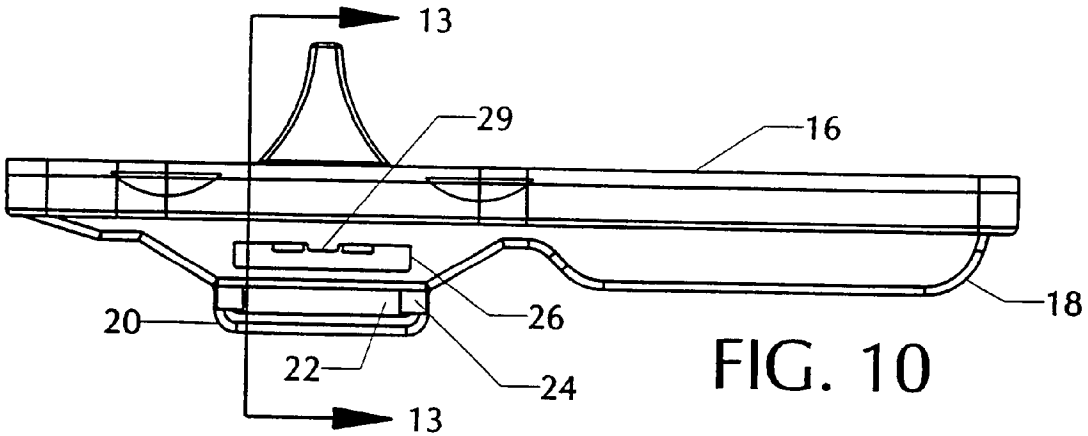
FIG. 10 is a front elevational view of an assembled tag in accordance with the invention.
Figure 9:
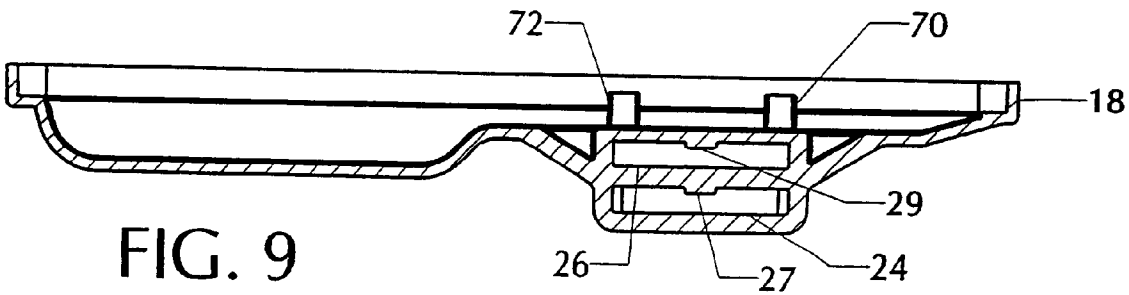
FIG. 9 is a rear elevational view of the second housing half of FIG. 8.
Figure 8:
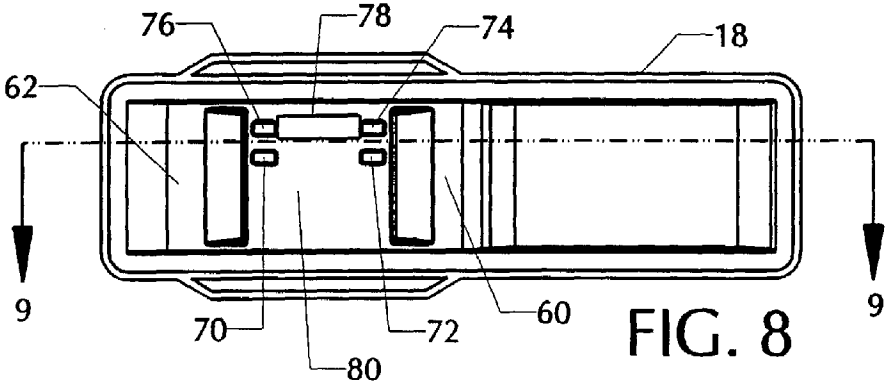
FIG. 8 is a top plan view of a second housing half of the invention.
Figure 11:
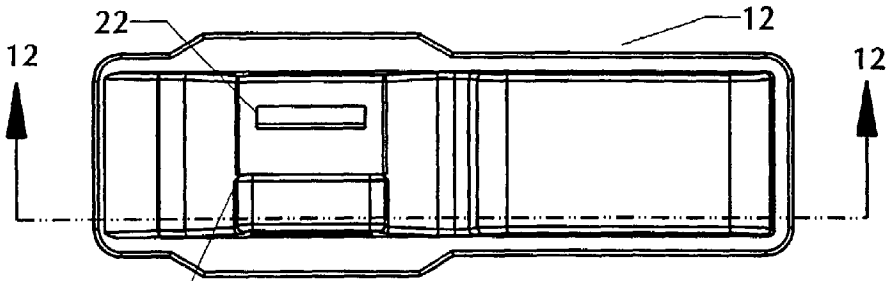
FIG. 11 is bottom plan view of the assembled tag of FIG. 10.
Figure 14:
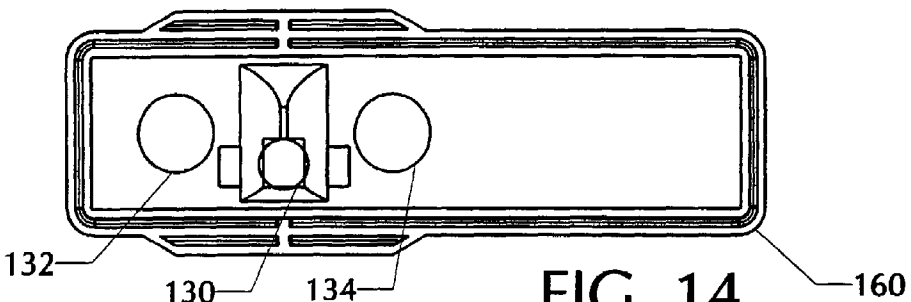
FIG. 14 is a top plan view of the second housing half in an alternate embodiment of the invention.
Figure 16A:
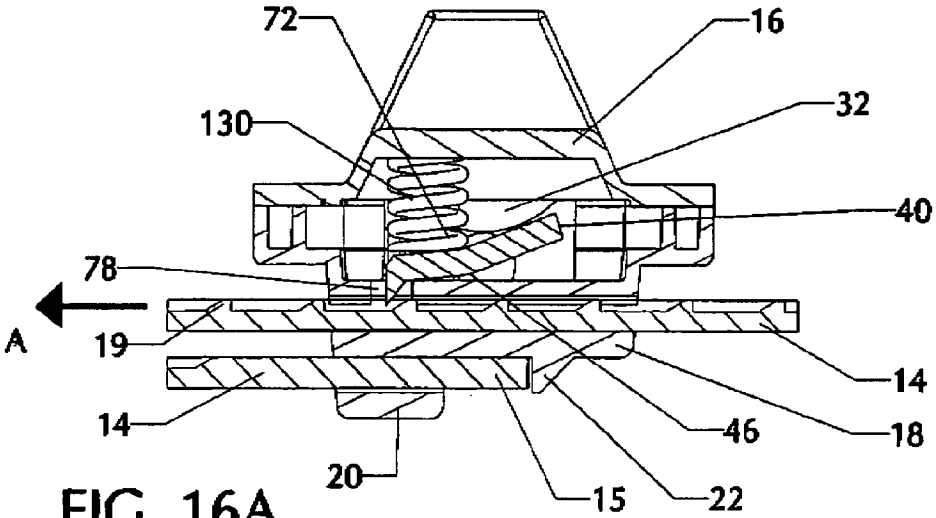
FIG. 16A is a left side cross-sectional elevational view of the second embodiment of the invention similar to the view of the first embodiment of the invention shown in FIG. 13A showing the pawl member in the engaged position.
Figures 15B, 16B:
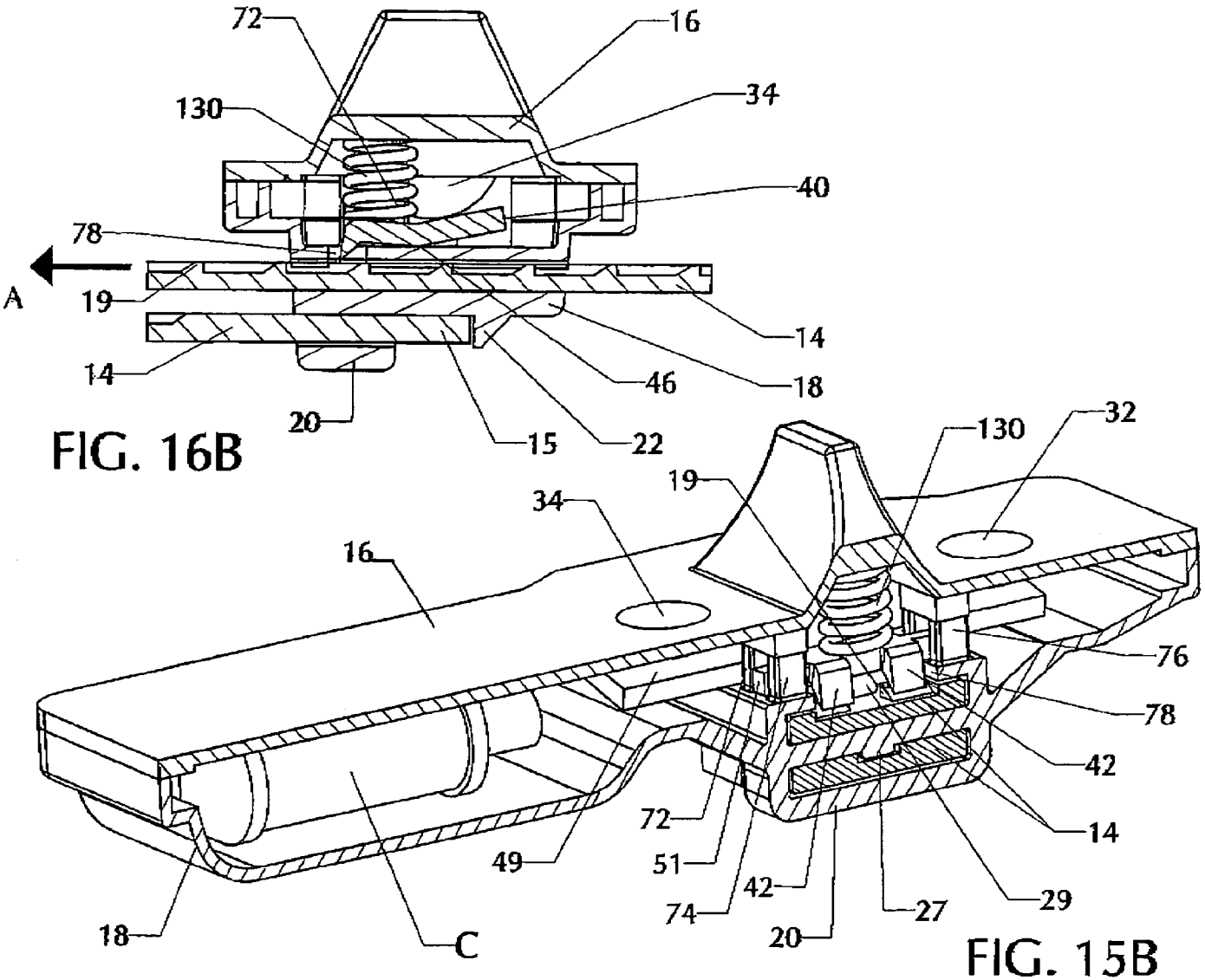
FIG. 15B is a front cross-sectional elevational view of the second embodiment of the invention similar to the view of the first embodiment of the invention shown in FIG. 12B showing the pawl member in the disengaged position
FIG. 16B is a left side cross-sectional elevational view of the second embodiment of the invention similar to the view of the first embodiment of the invention shown in FIG. 13B showing the pawl member in the disengaged position.
Figure 17:
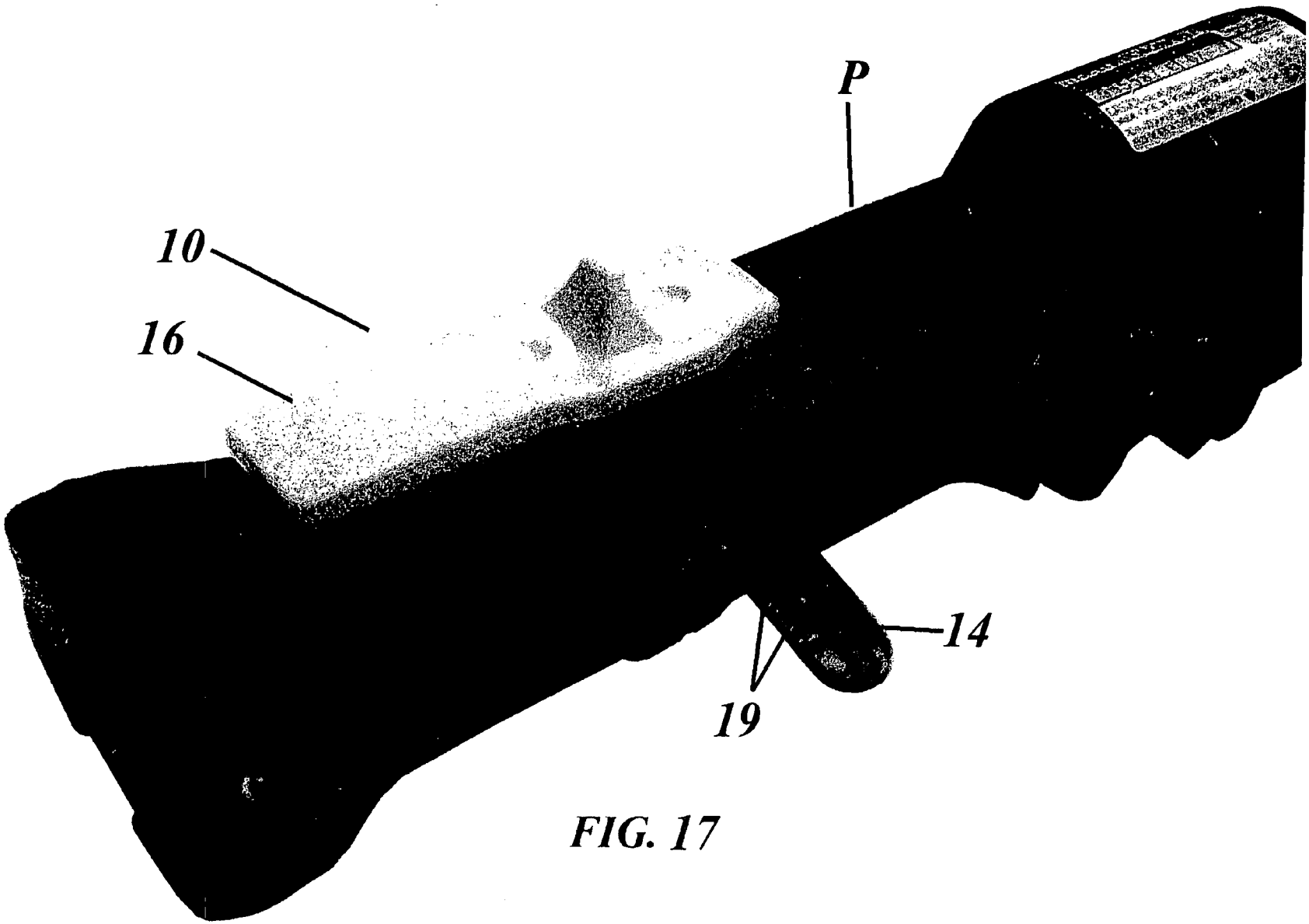
FIG. 17 is a perspective view of a security tag, affixed to a product via a lanyard, in accordance with the invention.

Referring now to FIGS. 14 16B, an alternative embodiment is shown in which a helical spring 130 is used as the biasing member in place of biasing member 30. In all other respects, the invention works as described in connection with FIGS. 1 through 13B, with the exception that spring 130 retains pawl 40 in its at rest position by exerting a biasing force on yoke 51, thereby causing pawl 40 to remain normally rotated into the position shown in FIGS. 15A, and 16A. When dimples 32, 34 (or other force exerting structure) are imposed upon bearing surface 49 of pawl 40 with sufficient force to overcome the spring force of spring 130, pawl 40 will rotate about fulcrum 46 into the detached position shown in FIGS. 15B, and 16B.

In all cases it is to be understood that the above described configurations are merely illustrative of the many possible specific embodiments which represent applications of the present invention. Numerous and varied other configurations can be readily devised in accordance with the principles of the present invention without departing from the spirit and scope of this invention.

The invention claimed is:

1. An article surveillance tag attachment apparatus for use with goods of varying size and shape, the attachment apparatus comprising:

a lanyard that includes a flexible, elongated body portion connected at one end to a stop portion, the stop portion having a width that is greater than a width of the elongated body portion, the elongated body portion including a plurality of parallel ridges disposed across at least a portion of the length of at least one side of the elongated body portion;

a housing that includes an inner surface and an outer surface, the inner surface defining an internal chamber, the outer surface defining a pair of spaced lanyard receiving passages, a first passage of the pair having a cross-sectional geometry configured to receive the elongated body portion, but not die stop portion, of the lanyard prior to securing of the lanyard to a good, the first passage of the pair being positioned further from the internal chamber than is a second passage of the pair, the second passage of the pair having a cross-sectional geometry configured to receive the elongated body portion of the lanyard during securing of the lanyard to the good, the lanyard and the pair of lanyard receiving passages being further arranged such that a first portion of the lanyard is spaced from and substantially parallel to a second portion of the lanyard when the first portion of the lanyard is positioned in the first passage and the second portion of the lanyard is positioned in the second passage, the housing defining at least one aperture which communicates the internal chamber with the second passage; and a pawl positioned within the internal chamber of the housing, the pawl including a body portion and at least one protrusion, the at least one protrusion being positionable through the at least one aperture and into the second passage such that the at least one protrusion engages at least one of the plurality of parallel ridges when the lanyard is secured to the good, thereby inhibiting removal of the lanyard from the second passage.

2. An article surveillance tag attachment apparatus for use with goods of varying size and shape, the attachment apparatus comprising:

a lanyard that includes a flexible, elongated body portion connected at one end to a stop portion, the stop portion having a width that is greater than a width of the elongated body portion, the elongated body portion including a plurality of parallel ridges disposed across at least a portion of the length of at least one side of the elongated body portion, wherein the plurality of parallel ridges are arranged along a length of the elongated body portion of the lanyard into pairs of horizontally spaced ridges such that each pair of ridges is separated by a channel;

a housing that includes an inner surface and an outer surface, the inner surface defining an internal chamber, the outer surface defining a pair of vertically spaced lanyard receiving passages, a first passage of the pair having a cross-sectional geometry configured to receive the elongated body portion, but not the stop portion, of the lanyard prior to securing of the lanyard to a good, the first passage of the pair being positioned further from the internal chamber than is a second passage of the pair, the second passage of the pair having a cross-sectional geometry configured to receive the elongated body portion of the lanyard during securing of the lanyard to the good, the housing defining at least one aperture which communicates the internal chamber with the second passage, wherein the first and second passages define first and second protrusions configured to nest with the channel of the lanyard during passage of the lanyard respectively through the first passage of the pair and the second passage of the pair; and a pawl positioned within the internal chamber of the housing, the pawl including a body portion and at least one protrusion, the at least one protrusion being positionable through the at least one aperture and into the second passage such that the at least one protrusion engages at least one of the plurality of parallel ridges when the lanyard is secured to the good, thereby inhibiting removal of the lanyard from the second passage.

3. The article surveillance tag attachment apparatus of claim 1, further comprising a biasing member positioned within the internal chamber, the biasing member engaging the body portion of the pawl proximate the at least one protrusion so as to bias the at least one protrusion within the second passage.

4. The article surveillance tag attachment apparatus of claim 3, wherein the biasing member is a coiled spring.

5. An article surveillance tag attachment apparatus for use with goods of varying size and shape, the apparatus comprising:

a lanyard that includes a flexible, elongated body portion connected at one end to a stop portion, the stop portion having a width that is greater than a width of the elongated body portion, the elongated body portion including a plurality of parallel ridges disposed across at least a portion of the length of at least one side of the elongated body portion;

a housing that includes an inner surface and an outer surface, the inner surface defining an internal chamber, the outer surface defining a pair of vertically spaced lanyard receiving passages, a first passage of the pair having a cross-sectional geometry configured to receive the elongated body portion, but not the stop portion, of the lanyard prior to securing of the lanyard to a good, the first passage of the pair being positioned further from the internal chamber than is a second passage of the pair, the second passage of the pair having a cross-sectional geometry configured to receive the elongated body portion of the lanyard during securing of the lanyard to the good, the housing defining at least one aperture which communicates the internal chamber with the second passage; and a pawl positioned within the internal chamber of the housing, the pawl including a body portion and at least one protrusion, the at least one protrusion being positionable through the at least one aperture and into the second passage such that the at least one protrusion engages at least one of the plurality of parallel ridges when the lanyard is secured to the good, thereby inhibiting removal of the lanyard from the second passage, wherein the at least one protrusion of the pawl comprises a pair of spaced protrusions and wherein the aperture comprises a pair of spaced apertures configured to receive the pair of spaced protrusions of the pawl.

6. The article surveillance tag attachment apparatus of claim 1, wherein the housing further comprises a stop element positioned substantially parallel to an entrance of the first passage of the pair and separated from the entrance by a distance nominally greater than a length of the stop portion of the lanyard, the stop element inhibiting removal of the lanyard from the first passage of the pair.

7. The article surveillance tag attachment apparatus of claim 1, wherein the housing comprises two interlocking housing members.

8. The article surveillance tag attachment apparatus of claim 1, further comprising a passive tuned circuit positioned within the internal chamber, the passive tuned circuit being responsive to at least one of electromagnetic energy, acoustomagnetic energy, and radio frequency energy.

9. The article surveillance tag attachment apparatus of claim 1, wherein the body portion of the pawl is further arranged and configured to respond to pressure exerted thereon by an independent detachment device such that, responsive to said pressure, the at least one protrusion of the pawl withdraws from the at least one aperture so as to facilitate removal of the lanyard from the second aperture of the pair.

10. The article surveillance tag attachment apparatus of claim 1, wherein the lanyard is generally T-shaped.

11. The article surveillance tag attachment apparatus of claim 1, wherein at least the elongated body portion of the lanyard is arranged and configured to resist insertion of a pin therethrough.

12. The article surveillance tag attachment apparatus of claim 11, wherein each of the elongated body portion and the stop portion of the lanyard comprises a solid plastic material.

13. A housing for use in an article surveillance system used with goods of varying size and shape, the article surveillance system including a lanyard having an elongated body portion connected to a stop portion, the housing comprising:

a plurality of inner surfaces defining an internal chamber; and a plurality of outer surfaces, a first group of the plurality of outer surfaces defining a pair of spaced lanyard receiving apertures, a first lanyard receiving aperture of the pair having a cross-sectional geometry configured to receive the elongated body portion, but not the stop portion, of the lanyard prior to securing of the lanyard to a good, the first lanyard receiving aperture of the pair being positioned further from the internal chamber than is a second lanyard. receiving aperture of the pair, the second lanyard receiving aperture of the pair having a cross- sectional geometry configured to receive the elongated body portion of the lanyard during securing of the lanyard to the good, an outer surface of the first group and an inner surface of the plurality of inner surfaces jointly defining at least one pawl access aperture positioned vertically adjacent the second lanyard receiving aperture of the pair, the pair of lanyard receiving apertures being further arranged so as to cause a first portion of the lanyard to be spaced from and substantially parallel to a second portion of the lanyard when the first portion of the lanyard is positioned in the first lanyard receiving aperture and the second portion of the lanyard is positioned in the second lanyard receiving aperture.

14. A housing for use in an article surveillance system used with goods of varying size and shape, the article surveillance system including a lanyard having an elongated body portion connected to a stop portion, the housing comprising:

a plurality of inner surfaces defining an internal chamber; and a plurality of outer surfaces, a first group of the plurality of outer surfaces defining a pair of vertically spaced lanyard receiving apertures, a first lanyard receiving aperture of the pair having a cross-sectional geometry configured to receive the elongated body portion, but not the stop portion, of the lanyard prior to securing of the lanyard to a good, the first lanyard receiving aperture of the pair being positioned further from the internal chamber than is a second lanyard receiving aperture of tire pair, the second lanyard receiving aperture of the pair having a cross-sectional geometry configured to receive the elongated body portion of the lanyard during securing of the lanyard to the good, an outer surface of the first group and an toner surface of the plurality of inner surfaces jointly defining at least one pawl access aperture positioned vertically adjacent the second lanyard receiving aperture of the pair, wherein the at least one pawl access aperture comprises a pair of spaced apertures.

15. The housing of claim 13, further comprising:

a stop element positioned substantially parallel to an entrance of the first lanyard receiving aperture of the pair and separated from the entrance by a distance nominally greater than a length of the stop portion of the lanyard, the stop clement inhibiting removal of the lanyard from the first lanyard receiving aperture of the pair.

16. The housing of claim 13, further comprising two interlocking housing members that collectively include the plurality of inner surfaces and the plurality of outer surfaces, such that the internal chamber is formed when the two housing members are interlocked.

17. The housing of claim 13, wherein the internal chamber is configured to enclose a passive tuned circuit that is responsive to at least one of electromagnetic energy, acousto-magnetic energy, and radio frequency energy.

18. An article surveillance tag attachment apparatus for use with goods of varying size arid shape, the attachment apparatus comprising:

a housing that includes two interlocking housing members, the housing members defining an internal chamber when locked together, one of the housing members defining an integrally formed lanyard, a lanyard receiving aperture spaced from the lanyard and at least one pawl access aperture positioned adjacent the lanyard receiving aperture, the lanyard including a flexible, elongated body portion, the elongated body portion including a plurality of parallel ridges disposed across a length of at least one side of the elongated body portion, the lanyard receiving aperture having a cross-sectional geometry configured to receive the elongated body portion of the lanyard during securing of the lanyard to a good, the lanyard receiving aperture being positioned closer to the internal chamber than is the lanyard; and a pawl positioned within the internal chamber of the housing, the pawl including a body portion and at least one protrusion, the at least one protrusion being positioned through the at least one pawl access aperture and into a volume of the lanyard receiving aperture such that the at least one protrusion engages at least one of the plurality of parallel ridges when the lanyard is secured to the good Thereby inhibiting removal of the lanyard from the lanyard receiving aperture.

19. An article surveillance tag attachment apparatus for use with goods of varying size and shape, the attachment apparatus comprising:

a housing that includes a plurality of inner surfaces and a plurality of outer surfaces, the plurality of inner surfaces defining an internal chamber, the plurality of outer surfaces defining a lanyard and a lanyard receiving aperture spaced vertically from the lanyard, the lanyard including a flexible, elongated body portion, the elongated body portion including a plurality of parallel ridges disposed across a length of at least one side of the elongated body portion, the lanyard receiving aperture having a cross-sectional geometry configured to receive the elongated body portion of the lanyard during securing of the lanyard to a good, the lanyard receiving aperture being positioned closer to the internal chamber than is the lanyard, an outer surface of the plurality of outer surfaces and an inner surface of the plurality of inner surfaces jointly defining at least one pawl access aperture positioned vertically adjacent the lanyard receiving aperture, wherein the plurality of parallel ridges are arranged along a length of the elongated body portion of the lanyard into pairs of horizontally spaced ridges such that each pair of ridges is separated by a channel, wherein an outer surface of the housing defining the lanyard receiving aperture includes a channel protrusion configured to pass through the channel of the lanyard during passage of the lanyard respectively through the lanyard receiving aperture;

a pawl positioned within the internal chamber of the housing, the pawl including a body portion and at least one protrusion, the at least one protrusion being positioned through the at least one pawl access aperture and into a volume of the lanyard receiving aperture such that the at least one protrusion engages at least one of the plurality of parallel ridges when the lanyard is secured to the good, thereby inhibiting removal of the lanyard from the lanyard receiving aperture; and a biasing device positioned within the internal chamber, the biasing device engaging the body portion of the yawl proximate the at least one protrusion so as to prevent the at least one protrusion from prematurely exiting the at least one yawl access aperture.

20. An article surveillance tag attachment apparatus for use with goods of varying size and shape, the attachment apparatus comprising:

a housing that includes a plurality of inner surfaces and a plurality of outer surfaces, the plurality of inner surfaces defining an internal chamber, the plurality of outer surfaces defining a lanyard and a lanyard receiving aperture spaced vertically from the lanyard, the lanyard including a flexible, elongated body portion, the elongated body portion including a plurality of parallel ridges disposed across a length of at least one side of the elongated body portion, the lanyard receiving aperture having a cross-sectional geometry configured to receive the elongated body portion of the lanyard during securing of the lanyard to a good, the lanyard receiving aperture being positioned closer to the internal chamber than is the lanyard, an outer surface of the plurality of outer surfaces and an inner surface of the plurality of inner surfaces jointly defining at least one yawl access aperture positioned vertically adjacent the lanyard receiving aperture; and a pawl positioned within the internal chamber of the housing, the pawl including a body portion and at least one protrusion, the at least one protrusion being positioned through the at least one yawl access aperture and into a volume of the lanyard receiving aperture such that the at least one protrusion engages at least one of the plurality of parallel ridges when the lanyard is secured to the good, thereby inhibiting removal of the lanyard from the lanyard receiving aperture, wherein the at least one protrusion of the pawl comprises a pair of spaced protrusions and wherein the at least one pawl access aperture comprises a pair of spaced pawl access apertures configured to receive the pair of spaced protrusions of the pawl.

21. The attachment apparatus of claim 18, further comprising a passive tuned circuit positioned within the internal chamber, the passive tuned circuit being responsive to at least one of electromagnetic energy, acousto-magnetic energy, and radio frequency energy.

22. The attachment apparatus of claim 18, wherein the body portion of the pawl is further arranged and configured to respond to pressure exerted thereon by an independent detachment device such that responsive to said pressure, the at least one protrusion of the pawl withdraws from the at least one pawl access aperture so as to facilitate removal of the elongated body portion of the lanyard from the lanyard receiving aperture.

23. The attachment apparatus of claim 18, wherein the elongated body portion of the lanyard is arranged and configured to resist insertion of a pin therethrough.

24. The attachment apparatus of claim 23, wherein the elongated body portion of the lanyard comprises a solid plastic material.

25. An article surveillance tag apparatus for use with goods of varying size and shape, the article surveillance tag apparatus comprising:

a lanyard that includes a flexible, elongated body portion connected at one end to a stop portion, the stop portion having a width that is greater than a width of the elongated body portion, the elongated body portion including a plurality of parallel ridges disposed across at least a portion of the length of at least one side of the elongated body portion;

a housing that includes an inner surface and an outer surface, the inner surface defining an internal chamber, the outer surface defining a pair of spaced lanyard receiving passages, a first passage of the pair having a cross-sectional geometry configured to receive the elongated body portion, but not the stop portion, of the lanyard prior to securing of the lanyard to a good, the first passage of the pair being positioned further from the internal chamber than is a second passage of the pair, the second passage of the pair having a cross-sectional geometry configured to receive the elongated body portion of the lanyard during securing of the lanyard to the good, the lanyard and the pair of lanyard receiving passages being further arranged such that a first portion of the lanyard is spaced from and substantially parallel to a second portion of the lanyard when the first portion of the lanyard is positioned in the first passage and the second portion of the lanyard is positioned in the second passage, the housing defining at least one aperture which communicates the internal chamber with the second passage;

a pawl positioned within the internal chamber of the housing, the pawl including a body portion and at least one protrusion, the at least one protrusion being positionable through the at least one aperture and into the second passage such that the at least one protrusion engages at least one of the plurality of parallel ridges when the lanyard is secured to the good, thereby inhibiting removal of the lanyard from the second passage; and a tuned circuit positioned within the internal chamber of the housing.

* * * * *